US008328899B2

(12) United States Patent
Adam et al.

(10) Patent No.: US 8,328,899 B2
(45) Date of Patent: Dec. 11, 2012

(54) METAL ALLOY POWDERS PRODUCTION

(75) Inventors: Gorgees Adam, Manukau (NZ); Jing Liang, Auckland (NZ)

(73) Assignee: Titanox Development Limited, Tauranga (NZ)

( * ) Notice: Subject to any disclaimer, the term of this patent is extended or adjusted under 35 U.S.C. 154(b) by 733 days.

(21) Appl. No.: 12/374,466

(22) PCT Filed: Jul. 20, 2007

(86) PCT No.: PCT/NZ2007/000192

§ 371 (c)(1),
(2), (4) Date: Sep. 17, 2009

(87) PCT Pub. No.: WO2008/010733

PCT Pub. Date: Jan. 24, 2008

(65) Prior Publication Data

US 2010/0015003 A1 Jan. 21, 2010

(30) Foreign Application Priority Data

Jul. 20, 2006 (NZ) ..... 548675

(51) Int. Cl.
*B22F 9/04* (2006.01)

(52) U.S. Cl. ..... 75/352; 75/359

(58) Field of Classification Search ..... None
See application file for complete search history.

(56) References Cited

U.S. PATENT DOCUMENTS

| | | | | |
|---|---|---|---|---|
| 4,373,947 | A | 2/1983 | Büttner et al. | |
| 6,152,982 | A | 11/2000 | Froes et al. | |
| 6,264,719 | B1 | 7/2001 | Zhang et al. | |
| 6,398,980 | B1 | 6/2002 | Reutova et al. | |
| 6,692,839 | B2 | 2/2004 | Zhang et al. | |
| 7,585,457 | B2 * | 9/2009 | Zhang et al. | 419/19 |
| 2005/0280190 | A1 * | 12/2005 | Fujita | 264/640 |

FOREIGN PATENT DOCUMENTS

| | | |
|---|---|---|
| GB | 813999 | 5/1959 |
| NZ | 502679 | 7/2001 |
| RU | 2016111 C1 | 7/1994 |
| WO | WO 99/09227 A1 | 2/1999 |
| WO | WO 2004/009857 A1 | 1/2004 |

OTHER PUBLICATIONS

Welham, N.J. et al. 1998 "Mechanical activation of the formation of an alumina-titanium trialuminide composite" *Intermetallics* 6:363-368.

* cited by examiner

*Primary Examiner* — George Wyszomierski
(74) *Attorney, Agent, or Firm* — Knobbe Martens Olson & Bear LLP

(57) ABSTRACT

The invention relates to a process for the production of metal alloy powders, in particular the invention relates to a process for producing titanium metal alloys from titanium dioxide and aluminium. Optionally the process can also include the use of one or more other oxides (metal or non-metal). The result is at least a Ti—Al alloy powder. If another metal oxide is used the result is a Ti-ternary alloy powder. If $SiO_2$ is used the result is a Ti—Al—Si alloy.

48 Claims, 11 Drawing Sheets

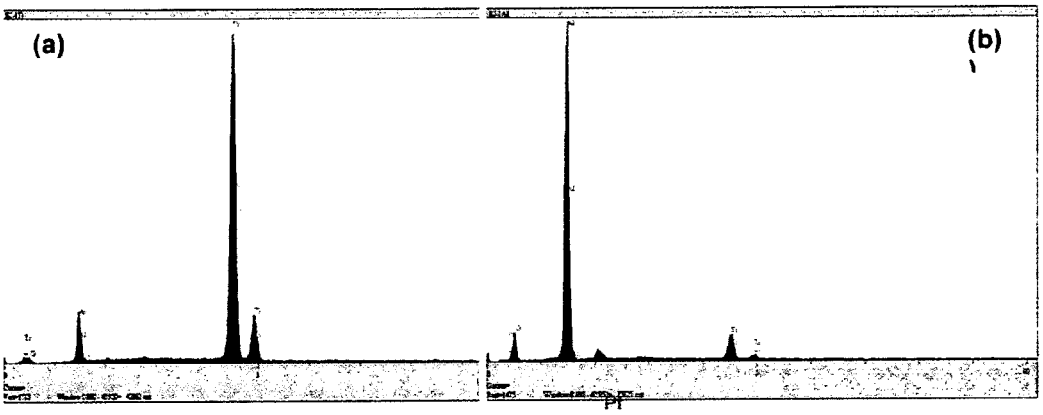
FIGURE 5 (a) and (b)
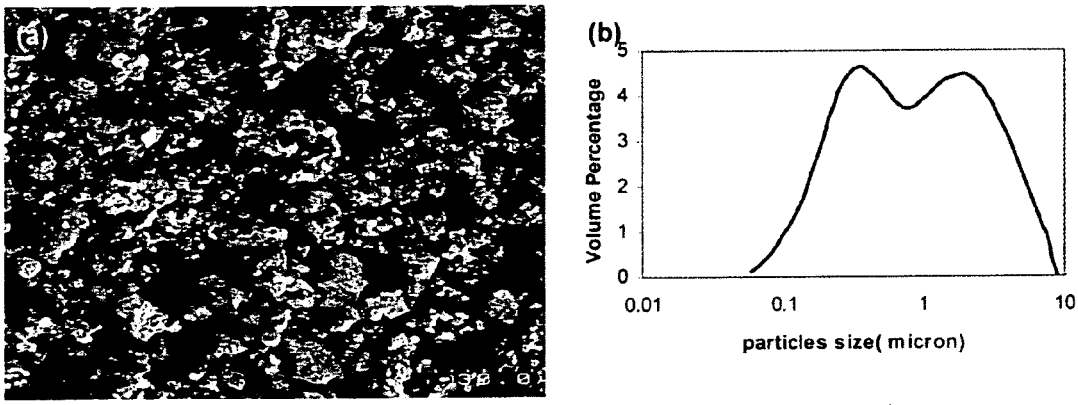
FIGURE 6 (a) and (b)

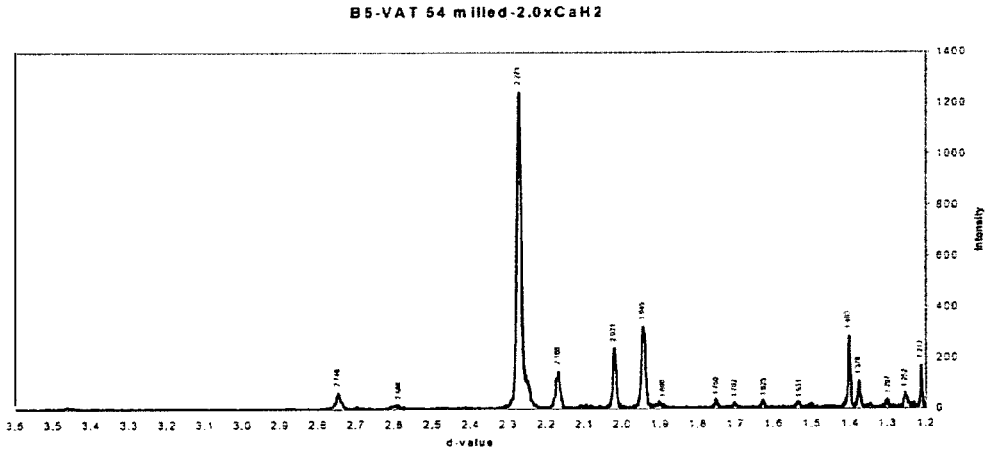
FIGURE 11
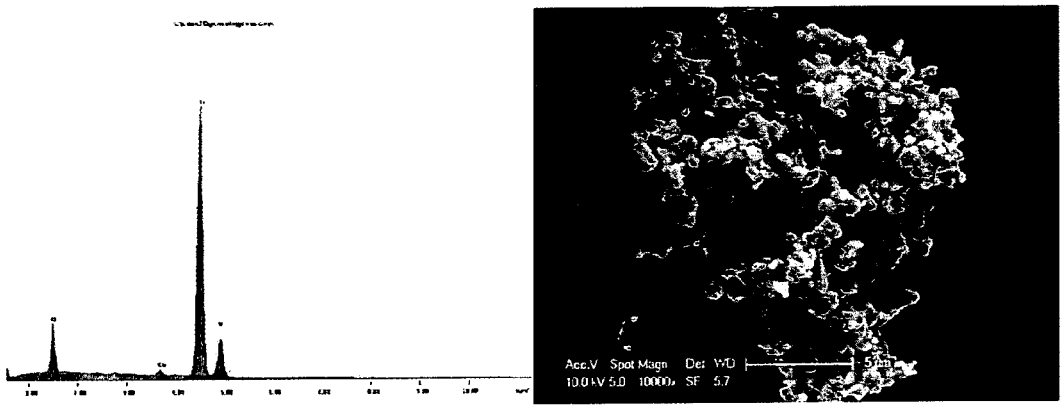
FIGURE 12 (a) and (b)

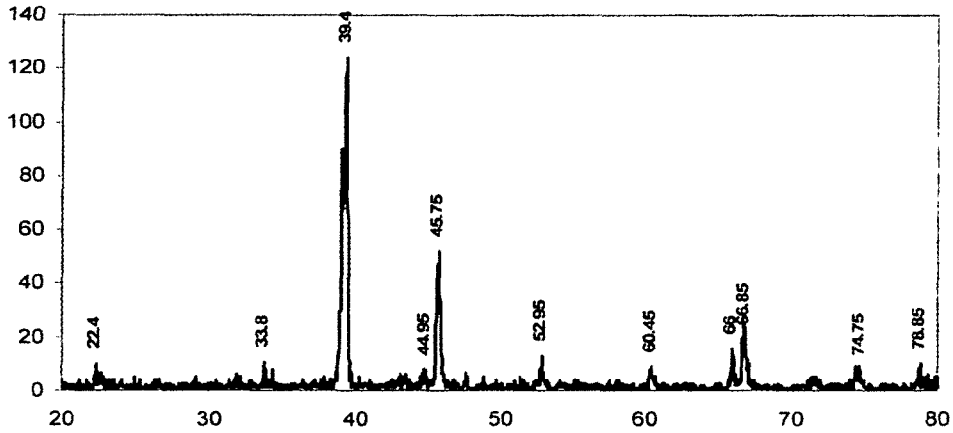
FIGURE 15
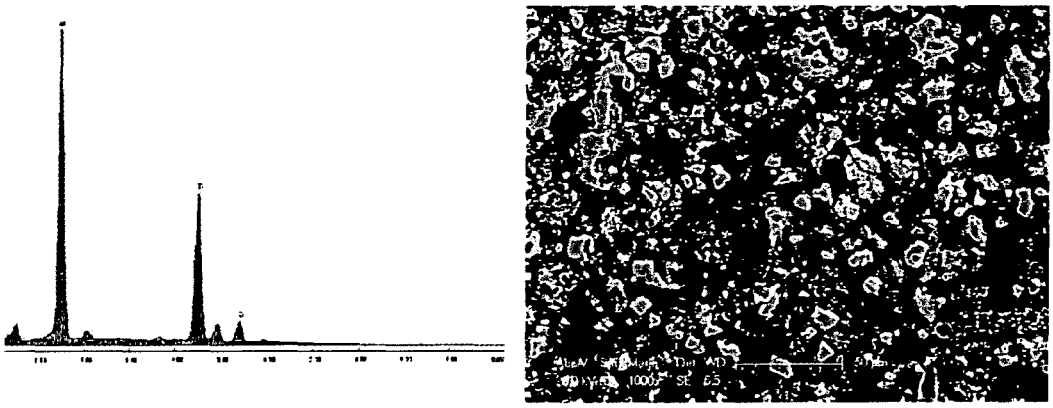
FIGURE 16 (a) and (b)

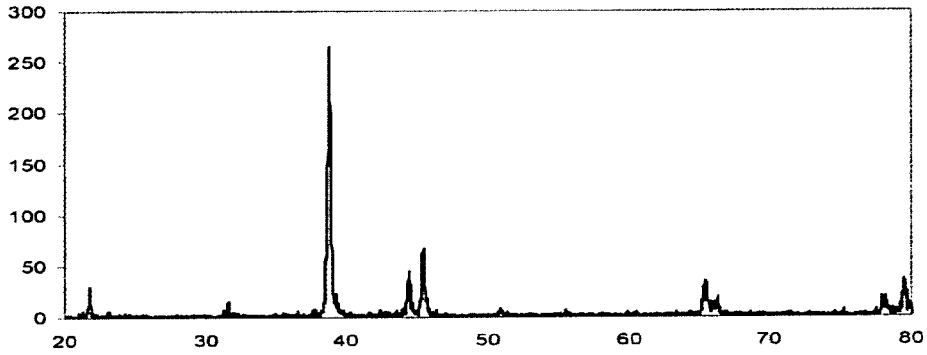
FIGURE 17
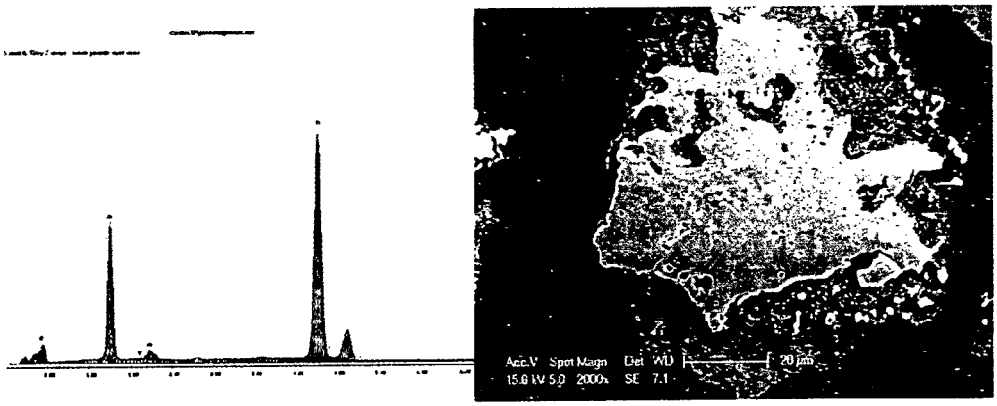
FIGURE 18 (a) and (b)

METAL ALLOY POWDERS PRODUCTION

This application is U.S. National Phase of International Application PCT/NZ2007/000192, filed Jul. 20, 2007 designating the U.S., and published in English as WO 2008/010733 on Jan. 24, 2008, which claims priority to New Zealand Patent Application No. 548675 filed Jul. 20, 2006.

TECHNICAL FIELD

The invention relates to a method for the production of metal alloy powders, in particular the invention relates to a method for the production of titanium alloy powders from titanium oxide starting materials.

BACKGROUND ART

Metal alloy powders, such as titanium alloy powders have both mechanical and corrosion resistance properties and can be used as structural materials in many industrial areas. Such areas include aerospace, automotive industries, chemical engineering industries, and even military hardware applications. This usefulness is primarily due to the characteristics of metal alloy powders such as their weight to strength ratio, oxidation resistance, and wear resistance amongst other characteristics. As a result, production of metal alloy powder, in particular titanium alloy powders, is always under constant investigation.

For example, titanium aluminides have been used as structural materials, coatings, and forming and near net shapes by applying powder metallurgy technology.

While titanium is the fourth most abundant metal in the earth's crust (0.86% by weight) behind aluminium, iron and magnesium, titanium alloys are not particularly widely used primarily due to the cost of processing the material. Similarly for the production of other metals and metal alloys, the cost and processing requirements are prohibitive.

There are a number of processes for the production of metals and metal alloy materials that have been described in the patent literature including, for example, that described in PCT/NZ2003/00159 entitled "A Separation Process" also to Titanox Development Limited. This document teaches the manufacture of metal alloy powders (e.g. TiAl) via a coarsening and separation step. This can then be followed by further reduction step using, amongst other reducing agents, calcium hydride. U.S. Pat. No. 6,231,636 to Froes et al teaches a mechanochemical process for producing Ti metals. The process uses a reduction reaction between a reducible metal compound (such as the chloride) and a metal hydride, by mechanochemical processing.

OBJECT OF THE INVENTION

There would be an advantage in being able to provide alternative methods for producing metal alloy powder materials in a cost-effective manner.

SUMMARY OF THE INVENTION

In a first aspect the invention provides a process for the manufacture of titanium alloy powders, the method including the following steps:

(a) mechanically milling titanium dioxide, and optionally one or more other oxides, together with aluminium powder;

(b) heating the mixture to a temperature of between about 700° C. and about 1200° C. in a vacuum or an inert environment to form a titanium metal matrix ceramic composite;

(c) crushing the titanium metal matrix ceramic composite;

(d) mixing the crushed titanium metal matrix ceramic composite with a suitable reducing agent and heating to a temperature between about 1100° C. and about 1500° C. in a vacuum or an inert environment to reduce the oxide components of the titanium metal matrix ceramic composite;

(e) crushing and washing the result of step (d); and (f) recovering the titanium alloy powder.

Preferably step (b) is carried out at a temperature of between about 900° C. and about 1100° C.

Preferably step (d) is carried out at a temperature of between about 1100° C. and about 1300° C.

Preferably, step (a) includes titanium dioxide and another metal oxide compound; and the titanium alloy powder recovered in step (e is a titanium based metal alloy powder.

Preferably step (a) is carried out for a time of between about one and about 10 hours; and more preferably step (a) is carried out for a time of between about one and about four hours.

Preferably, step (a) includes titanium dioxide and at least one other metal oxide or at least one non-metal oxide.

Preferably, the other metal or non-metal oxide is selected from any one or more of Ni, V, Co, Nb, Cr, Mo, Y, or Si oxide.

Preferably the alloy powder produced is a Ti—Al—Ni, Ti—Al—V, Ti—Al—Co, Ti—Al—Nb, Ti—Al—Cr, Ti—Al—Mo, Ti—Al—Y or a Ti—Al—Si alloy.

Preferably the non-metal oxide is $SiO_2$ and the product of step (f) is a Ti—Al—Si alloy.

Preferably, step (a) is carried out in a vacuum or an inert environment.

Preferably step (a) combines $TiO_2$ and Al powders; the product of step (d) is a mixture of Ti—Al and soluble compounds; and a Ti—Al alloy is recovered in step (f).

Preferably, step (c) is also carried out in a vacuum or an inert environment.

Preferably, step (b) is carried out in an inert environment and steps (c), and (d) are carried out in the same inert environment.

Preferably, the inert environment in steps (a), (b), (c), and (d) is an argon environment.

Preferably, step (b) is carried out for at least about ten minutes; more preferably between about one and about two hours.

Preferably, step (d) is carried out for between about two and about eight hours; more preferably between about two and about four hours.

Preferably, the suitable reducing agent used in step (d) is calcium or magnesium hydride; most preferably calcium hydride.

Preferably, the crushing steps in steps (c) and (e) is carried out for a time of between about ten minutes and about one hour using a mechanical milling machine such as a ball or discus milling machine.

Preferably the washing step in step (e) is a multi-step process using deionised water and a weak organic acid, for example acetic acid, in deionised water.

In a second aspect the invention provides a titanium alloy powder when produced by a process of the first aspect of the invention.

In a third aspect, the invention provides a powder when produced by step (b) as an intermediate product for use in the process of the first aspect of the invention.

In a fourth aspect the invention provides a process for the manufacture of titanium aluminide powder, the method including the following steps:

(a) mechanically milling titanium dioxide together with aluminium powder;

(b) heating the mixture to a temperature of between about 700° C. and about 1200° C. in a vacuum or an inert environment to form a titanium metal matrix ceramic composite;

(c) crushing the titanium metal matrix ceramic composite;

(d) mixing the crushed titanium metal matrix ceramic composite with a suitable reducing agent and heating to a temperature between about 1100° C. and about 1500° C. in a vacuum or an inert environment to reduce the oxide component of the titanium metal matrix ceramic composite;

(e) crushing and washing the result of step (d); and (f) recovering the titanium aluminide powder.

Preferably step (b) is carried out at a temperature of between about 900° C. and about 1100° C.

Preferably step (d) is carried out at a temperature of between about 1100° C. and about 1300° C.

In a fifth aspect the invention provides a process for the manufacture of titanium alloy powders, the method including the following steps:

(a) heating a blended mixture of titanium dioxide, and optionally one or more other oxides, together with aluminium powder to a temperature of between about 700° C. and about 1200° C. in a vacuum or inert environment to form a titanium metal matrix ceramic composite;

(b) crushing the titanium metal matrix ceramic composite;

(c) mixing the crushed titanium metal matrix ceramic composite with a suitable reducing agent and heating to a temperature between about 1100° C. and about 1500° C. in a vacuum or an inert environment to reduce the oxide components of the titanium metal matrix ceramic composite;

(d) crushing and washing the result of step (c); and (e) recovering the titanium alloy powder.

Preferably the blended mixture in step (a) is blended by mechanical milling or low energy mixing techniques.

In a sixth aspect the invention provides a titanium alloy powder when produced by a process according to the fourth or fifth aspect of the invention.

In a seventh aspect the invention provides a titanium metal matrix ceramic composite powder when produced by step (b) as an intermediate product for use in the process of the first, fourth or fifth aspect of the invention.

In an eighth aspect the invention provides a process for the manufacture of titanium alloy powders, the method including the following steps:

(a) blending titanium dioxide, and optionally one or more other oxides, together with aluminium powder;

(b) heating the mixture to a temperature of between about 700° C. and about 1200° C. in a vacuum or an inert environment to form a titanium metal matrix ceramic composite;

(c) crushing the titanium metal matrix ceramic composite;

(d) mixing the crushed titanium metal matrix ceramic composite with a suitable reducing agent and heating to a temperature between about 1100° C. and about 1500° C. in a vacuum or an inert environment to reduce the oxide components of the titanium metal matrix ceramic composite;

(e) crushing and washing the result of step (d); and (f) recovering the titanium alloy powder.

Preferably blending includes mechanical milling or low energy mixing techniques.

In a ninth aspect the invention provides a titanium alloy powder when produced by a process according to the eighth aspect of the invention.

Other aspects of the invention will become apparent on reading the description of the present invention.

FIGURES

Preferred embodiments of the invention are shown in the attached Figures, in which:

FIG. 1: shows the XRD pattern of the as-milled Al/$TiO_2$ powder produced by high-energy mechanical milling for 1 hour using the discus mill.

FIG. 2: shows a SEM micrograph of the cross section of the powder particles of the as-milled powder.

FIG. 3: shows the XRD pattern of the Ti(Al,O)/$Al_2O_3$ composite powder produced by heat treating the Al/$TiO_2$ composite powder for 2 hours at 1000° C.

FIG. 4: shows a typical SEM backscattered micrograph of a Ti(Al,O)/$Al_2O_3$ powder particle.

FIG. 5: shows the EDX spectra from different zones in a Ti(Al,O)/$Al_2O_3$ composite powder particle (a) Ti(Al,O) phase and (b) $Al_2O_3$ phase.

FIG. 6: (a) shows the particle morphology of the fine Ti(Al,O)/$Al_2O_3$ powder, and (b) particle size distribution.

FIG. 7: shows the XRD pattern of the final Ti—Al powder after reduction, crushing and washing.

FIG. 8: shows the Ti—Al particle morphology of the powder after processing followed by reduction reaction and washing.

FIG. 9: shows the XRD pattern of the as-milled powder in the production of Ti—Al—V.

FIG. 10: shows the XRD pattern of the heat treated powder, at 1200° C. for 4 hrs in a horizontal tube furnace under argon gas protection to produce Ti—Al—V.

FIG. 11: shows the XRD pattern of Ti—Al after heat treatment in a pre-test example.

FIG. 12: (a) shows the EDX spectrum of Ti—Al—V powder and (b) the SEM micrograph of dried, but not finally crushed Ti—Al—V powder particles.

FIG. 13: shows the XRD pattern of the final Ti-6Al-4V product powder after crushing and washing.

FIG. 14: shows the XRD pattern comparison between a standard Ti-6Al-4V powder and the Ti-6Al-4V powder produced using a process of this invention.

FIG. 15: shows the XRD pattern of the final Ti—Al—Cr powder product after reduction reaction, crushing and washing.

FIG. 16: (a) shows the EDX spectrum of Ti—Al—Cr; (b) and a SEM micrograph of the cross-section of Ti—Al—Cr particles.

FIG. 17: shows the XRD pattern of the final Ti—Al—Y powder product after reduction, crushing and washing.

FIG. 18: a) shows the EDX spectrum of the final Ti—Al—Y powder after reduction, crushing and washing and b) a SEM micrograph of cross-section of a typical Ti—Al—Y particle.

FIG. 19: shows a schematic diagram illustrating experimental processing to produce TiAl from $TiO_2$ and Al.

FIG. 20: shows a schematic diagram illustrating experimental processing for producing Ti—Al—M alloy powders.

DETAILED DESCRIPTION OF THE INVENTION

This invention relates to a process for producing titanium metal alloys from titanium oxide (i.e. $TiO_2$) and aluminium. If titanium dioxide and aluminium only are used as the starting materials then the result is a Ti—Al alloy. Optionally the process can also include the use of one or more other oxides (metal or non-metal). This other oxide material can be selected from oxides of Ni, V, Co, Nb, Cr, Mo, Y, Si, or other similar oxides. The result is at least a Ti—Al alloy powder. If another metal oxide is used the result is a Ti-ternary alloy powder. If $SiO_2$ is used the result is a Ti—Al—Si alloy.

In PCT/NZ2003/00159 the present Applicant disclosed that by heating a $Ti_xAl_y/Al_2O_3$ bulk composite, for example, to a temperature range of between about 1500° C. and about 1650° C. and holding at the temperature for a set period of time, ranging from about 0.5 to about 10 hours, at least the $Al_2O_3$ particles were significantly coarsened. The material produced was more favourable for later separation steps. This was considered contrary to conventional wisdom as the coarsening of the embedded particles within a composite is usually undesirable, as coarsened particles can decrease the overall strength of the final product. In order to facilitate this separation, the composite with the coarsened $Al_2O_3$ particles was then crushed and milled to produce a $Ti_xAl_y(O)/Al_2O_3$ powder from which the coarsened material could be separated.

In an optional step in the process disclosed in PCT/NZ003/00159, $Ti_xAl_y(O)$ rich powder having a volume fraction of $Al_2O_3$ preferably less than about 15% can be further reduced by mixing with calcium, calcium hydride or other reductants. This is then heated to facilitate the reaction of the $Al_2O_3$ and to reduce the dissolved oxygen content in the $Ti_xAl_y(O)$ phase.

Surprisingly, the present Applicant has now found that the coarsening and separation steps required by the process disclosed in PCT/N7003/00159 can be avoided, with the process still providing high-quality metal alloy powder materials, using a suitable reducing agent, such as calcium or magnesium hydride, in the process. Further, the Applicant has also found that this process, absent the coarsening and separation steps, also allows the inclusion of other oxides with the $TiO_2$ together with aluminium. This use of multiple oxides has the advantage that the process can produce multiple metal (or metal/non-metal) alloy powder, which includes titanium.

Calcium hydride is the preferred suitable reducing agent as, following its use as a reductant material, the resultant "waste" calcium oxide product of the reduction step is soluble and can be washed out with water. $CaH_2$ is also readily available and relatively easy to handle. $MgH_2$ is also an option but is more difficult to handle and the dissolvable products resulting from its use are less environmentally acceptable, and thus $MgH_2$ is less preferred. The solubility of the resultant product of the use of the suitable reducing agent is important as it allows the alloy powder produced not to be detrimentally affected by reaction with the resulting product of the reduction step. Other suitable reducing agents that also have the ability to produce a soluble product could also be used in this process. Reference to "suitable reducing agent" in this specification should be taken to refer to a reducing agent having these qualities.

The first step of the process according to the present invention (eg step (a)—first aspect of the invention) involves mechanically milling titanium dioxide, optionally with one or more other oxides, together with aluminium powder. These components form the charge powders to be placed inside the milling apparatus. The optional other oxide can be selected from any one or more oxides of Ni, V, Co, Nb, Cr, Mo, Y, or similar or non-metals such as Si, for example. Thus production of titanium ternary metal/non metal alloys including one or more other metals can be produced.

In one example, the milling may involve using high energy discus milling apparatus.

Whilst specific reference is made to the use of high energy discus milling apparatus, it is not intended that the milling in this invention be restricted to simply this type of milling, although the apparatus must involve a high energy system capable of providing energy sufficient to deform, fracture and cold weld particles. Other apparatus capable of providing the required conditions are also contemplated and will be understood by persons skilled in the art. It is also considered, for example, that a split discus-type mill or planetary apparatus may be appropriate.

The components ($TiO_2$, optionally one or more other oxides, and Al powder) are placed within the milling apparatus and the process is continued until a powder having the desired particle characteristics is attained. Normally, it is anticipated that the given period will be in the range of about one to about ten hours, although this will depend upon the actual parameters of the system and choices made by the user. For example, use of a high energy discus mill may allow shorter times (e.g. one to about four hours) while ball mills may require longer times (e.g. seven to about ten hours). Typically, at the end of the milling process there will be a blended powder including fine fragments and a mixture of fine phases. The amount of the starting components used is based on the desired stoichiometric ratio of the product. For example, a small amount of an additional metal oxide (eg Y, Ni, Cr, Mo oxide etc) could be included to improve the quality of Ti alloys for various applications, such as coating applications.

Preferably the milling process is performed under an atmosphere inert to the components. The preferred gas being argon, however, other suitable gases of use with Ti processing known to the skilled person could also be used. A vacuum environment could also be used if desired.

It is envisaged that the initial milling step could be optionally part of the process of the invention as the milled product could be separately provided for use in the remaining steps.

In an alternative embodiment of the invention step (a) requires the blending of the titanium dioxide, optionally with one or more other oxides, together with aluminium powder. "Blending" according to the present invention includes any known blending technique. This includes, amongst other techniques, low energy mixing. Similar techniques as would be used in the mixing process of step (d) could be used. Blending will also include within its scope mechanical milling, such as described in connection with step (a) as discussed earlier. The remaining steps of the process according to this alternative embodiment are not altered.

Following milling (or other blending techniques), the powder mixture is heated to a temperature of between about 700° C. and 1200° C., preferably also in a vacuum or an inert environment, to form a titanium metal matrix ceramic composite (step (b)). It is more preferred to use a temperature of between about 900° C. and 1100° C. This heating step can also be carried out in an inert or vacuum environment. This heating step can be carried out in a chamber or tube furnace and should be carried out for at least ten minutes, more preferably for between about one and two hours. The furnace should be capable of retaining the inert or vacuum environment.

The titanium metal matrix ceramic composite formed from the heating step, is then crushed to a powder form (step (c)). The crushing step can be carried out by using any known standard devices. Preferably, a ball mill with controllable speed or a discus mill is used. The time selected should be such that the particle size produced is suitable for the further processing desired (e.g. powder metallurgy, coatings etc.).

Following crushing, the crushed metal matrix ceramic composite is then mixed with a suitable reducing agent, such as calcium or magnesium hydride, and heated to a temperature between about 1100° C. and 1500° C. in a vacuum or an inert environment (step (d)). It is more preferred to use a temperature of between about 1100° C. and 1300° C. The amount of $CaH_2$ (or $MgH_2$) will be included according to stoichiometric ratio requirements. Mixing can be carried out by any suitable low energy technique that results in a blending of the components. The environment is preferably of the same type as used for the milling process. This heating step can again be carried out in a furnace such as a chamber or tube furnace for at least about one hour and preferably and between about two and four hours. This heating step using the suitable reducing agent (e.g. calcium hydride) results in chemical reduction of the oxide component of the titanium metal matrix ceramic composite and the formation of a titanium based alloy plus calcium oxide and other soluble compounds. The calcium oxide and other soluble products are then washed from the alloy, as discussed below.

As discussed earlier, the use of calcium hydride as the reducing agent has the particular advantage of the resultant product of the reduction step being a soluble calcium oxide which can then be washed from the desired product. A similar reduction result would be achieved by using $MgH_2$, but the "waste" soluble product (MgO) is less environmentally acceptable.

The crushing process after the reduction step is preferably carried out using a ball mill or discus mill or similar device. The crushing time selected should be sufficient to result in a particle size suitable for washing and allowing the release of the impurities (e.g. CaO) from the crushed powder. For washing, deionised water should preferably be used to reduce the presence of harmful ions. The washing process should be repeated, and include washing with deionised water followed by decanting of the water from the powder. This is followed by final washing with a weak organic acid solution, such as acetic acid in deionised water (preferably less than about 15 wt % acid concentration).

Following washing of the crushed products after the reduction process, the desired titanium alloy powder is then collected (step (f)) by known means.

As will be apparent, it is possible that production of the intermediate titanium metal ceramic composite could be completed separately to the reduction and the final alloy recovery steps. The composite powder could be stored, possibly transported, and undergo the reduction step later, possibly at another site. Similarly, the milled intermediate product could be stored, and possibly transported, for heat treatment at a later place or time. Such a temporally split process is also intended to be included within the scope of this invention. The milled Ti oxide (and optionally one or more other oxides) plus Al, and/or the titanium metal matrix composite material, as intermediates in the process of this invention may also be another aspect of this invention.

As will be readily apparent, the metal alloy powder product, which is produced by the process according to the present invention, will depend upon the charge powders which are used in the initial milling step (i.e. step (a)). The charge powders will include titanium dioxide and aluminium powder, optionally together with one or more other oxides. High quality Ti—Al can be produced, as can Ti ternary metal/non-metal alloys such as Ti—Al—V; Ti—Al—Nb, Ti—Al—Co, Ti—Al—Cr, Ti—Al—Y, Ti—Al—Mo, Ti—Al—Ni and Ti—Al—Si alloys. As will be apparent to a skilled person, a variety of compositions of the individual titanium alloys are possible. Formation of any particular composition will depend on the stoichiometric ratio of the starting materials used in the process.

In the following Examples, experimental processing to produce TiAl from $TiO_2$ and Al was performed according to the schematic diagram shown in FIG. 19.

Different compositions of the starting materials $TiO_2$ and Al were targeted.

The amount of the suitable reducing agent (e.g. $CaH_2$) was calculated from the stoichiometric ratios used for the selected chemical reaction. Such matters would be well within the knowledge of a skilled person in this field.

Mechanical milling of $TiO_2$ and Al powder for each option was done for 2 hours using a high energy discus-milling machine from Rock Lab Co. Ltd (a local New Zealand company). The milling was followed by heat-treatment using a reaction chamber device made by a local company from New Zealand (The Electric Furnace Co. Ltd) to perform the reduction reaction. Both milling and heat-treatment processes were performed in an argon gas environment. Instrument grade argon was used in the stages of processing that were done in an inert environment. De-ionised water, which had been produced by an Ion-Exchanger made by the firm Viola (USA), was used for washing crushed powder.

Crushing of the intermediate ($Ti(Al,O)/Al_2O_3$) and the final Ti—Al based powder was performed using centrifugal ball mills S100 made by Fa. Retsch, Germany, as was used for the initial mechanical milling. Reduction reaction process was performed using a horizontal tube furnace made by a local company from New Zealand (The Electric Furnace Co. Ltd).

The analyses of the various powders produced were completed by the University of Auckland-Research Centre for Surface and Material Science, and the Institute for Material Science, Fraunhofer Society, Dresden, Germany.

EXAMPLES

(A) Production of Titanium Aluminium Alloy Powders from Titanium Oxide and Al Mixture of Powders Using Reduction Reaction

Example 1

Processing of the $Al/TiO_2$ Powder

FIG. 1 shows the XRD pattern of the as-milled $Al/TiO_2$ powder produced by high-energy mechanical milling for 1 hour using the discus mill.

The XRD pattern shows $TiO_2$ and Al as the only existing phases. From this it may be concluded that there was no significant reaction between the phases during mechanical milling.

FIG. 2 shows a Scanning Electron Microscopy (SEM) micrograph of the cross section of the powder particles of the as-milled powder. The powder particles exhibit composite structure consisting of $TiO_2$ particles (the dark phase) embedded in elongated Al particles (the bright phase).

Differential Thermal Analysis (DTA) was then used in order to investigate the thermal behaviour of the $Al/TiO_2$ composite powder. This helped to give an indication at what temperature at which the reactions occurred.

FIG. 3 shows the XRD pattern of the $Ti(Al,O)/Al_2O_3$ composite powder produced by heat treating the $Al/TiO_2$ composite powder for 2 hours at 1000° C. under argon gas protection. The XRD pattern reveals Ti(Al,O) and $Al_2O_3$ as the major phase. This confirms that heat treating the $Al/TiO_2$ composite powder for 2 hrs at between about 700° C.-1200° C. is sufficient to turn the $Al/TiO_2$ composite powder into a $Ti(Al,O)/Al_2O_3$ composite powder.

The microstructure of the $Ti(Al,O)/Al_2O_3$ composite powder particles was examined using Scanning Electron Microscopy (SEM).

FIG. 4 shows a typical SEM backscattered micrograph of a cross section of a $Ti(Al,O)/Al_2O_3$ powder particle. The SEM examination showed that the $Al_2O_3$ particles were uniformly distributed in the Ti(Al,O) matrix. The bright phase is Ti(Al,O) and the dark phase is $Al_2O_3$.

The compositions of the different phases in the composite material were investigated using SEM and EDX technology. The EDX spectrum of the Ti(Al,O) matrix (FIG. 5(*a*)) shows Ti and Al peaks as major peaks and the 0 peak as a minor peak. This confirms that the matrix is a Ti rich phase, which contains a substantial amount of dissolved Al and O. The EDX spectrum of the $Al_2O_3$ particles (FIG. 5(*b*)) revealed only Al and O peaks confirming that they are $Al_2O_3$ phase. The spectrum also shows a weak Pt peak which is caused by the coating material applied to the resin mounted sample, and a weak Ti peak which is likely to be caused by signals from the surrounding matrix material.

FIGS. 6(*a*) and (*b*) show the particle morphology (6(*a*)) and particle size distribution (6(*b*)) of the $Ti(Al,O)/Al_2O_3$ powder produced after mechanical milling (crushing) of the $Ti(Al,O)/Al_2O_3$ composite powder for 10 min using a discus mill. All the particles are equiaxed. The particle size distribution curve of the powder shows two overlapping peaks in the range of 0.08-10 micron.

This was then followed by the reduction of the fine $Ti(Al,O)/Al_2O_3$ powder in a horizontal tube furnace using $CaH_2$ powder at a temperature range of between about 1100° C. and 1500° C. for a period of 2-8 hours under argon gas protection. The temperature used in this particular example was 1100° C. and the time was 4 hours.

Reduction was followed by crushing (in a discus mill) of the reduction product in order to increase the surface area of the powder particles. The crushing process can be performed using mechanical milling equipment for a period of time of preferably between 10 mins to 1 hour. The time used in this particular example was 30 mins. This increases the efficiency of the following washing process to remove resulting soluble end products. Washing was multi-step using deionised water followed by a weak solution of acetic acid in deionised water (10 wt % acetic acid).

The final analysis results, following the operation of crushing, washing and drying out the final powder product, are shown.

The XRD pattern of the final Ti—Al powder after reduction, crushing and washing is shown in FIG. 7. The XRD pattern shows a single phase of Ti—Al alloy and no unwashed residual phases.

SEM micrograph of the final Ti—Al powder particles morphology after reduction and washing is shown in FIG. 8. This shows fine particles of Ti—Al with equiaxed shapes.

The powder particle sizes are as shown in the following table—Table 1:

TABLE 1

| Diameter (μm) | q(%) | Sum: Q(r) (%) |
|---|---|---|
| 0.877 | 0.190 | 0.190 |
| 1.005 | 0.911 | 1.101 |
| 1.151 | 2.908 | 4.009 |

TABLE 1-continued

| Diameter (μm) | q(%) | Sum: Q(r) (%) |
|---|---|---|
| 1.318 | 6.180 | 10.189 |
| 1.510 | 9.067 | 19.256 |
| 1.729 | 9.789 | 29.045 |
| 1.981 | 8.453 | 37.498 |
| 2.269 | 6.399 | 43.897 |
| 2.599 | 4.651 | 48.547 |
| 2.976 | 3.514 | 52.062 |
| 3.409 | 2.939 | 55.001 |
| 3.905 | 2.828 | 57.829 |
| 4.472 | 3.167 | 60.996 |
| 5.122 | 4.040 | 65.036 |
| 5.867 | 5.544 | 70.580 |
| 6.720 | 7.428 | 78.008 |
| 7.697 | 8.477 | 86.486 |
| 8.816 | 6.929 | 93.415 |
| 10.097 | 3.852 | 97.266 |
| 11.565 | 2.103 | 99.369 |
| 13.246 | 0.631 | 100.000 |

Table 1 shows the presence of fine particles of the Ti—Al final powder.

(B) Production of Advanced Titanium Alloys Powders for Different Applications (e.g. Production of Titanium Vanadium Aluminium and Other Ternary Metal Alloys) from Their Oxides and Al FIG. 20 is a schematic diagram showing the experimental processing of this part of technology for producing Ti—Al—M alloy powders.

Example 2

A pre-test was carried out, this pre-test comprising mixing vanadium oxide, $V_2O_5$, together with $TiO_2$, and Al. This mixture was prepared based on the stoichiometric ratio of $[TiO_2,Al]:V$ of 98:2(wt %). The powder mixture was mechanically milled in a discus mill for 1 hr. Milling was performed under argon gas protection.

Different phases within the milled powders were analysed by XRD. FIG. 9 shows the XRD pattern of the as milled powder. The XRD pattern revealed $TiO_2$, and Al as the main dominant phases and $VO_2$ as the minor phase. This indicates that no reaction occurred between $TiO_2$, and Al phases and the only reaction occurring during milling was the reduction of the first form of vanadium oxide to its nearest oxide $VO_2$.

FIG. 10 shows the XRD pattern of the heat treated powder, at 1200° C. for 4 hrs in a horizontal tube furnace under argon gas protection. The XRD pattern for the heat treated powder in FIG. 10 exhibits $Al_2O_3$ as the main dominant phase, the titanium rich phase as $Ti_3Al$, and also the vanadium phases AlVO and VO as minor phases.

The heat treated powder was then crushed, and this step was followed by the reduction of the heat treated powder using $CaH_2$ powder at a temperature of 1200 C.° for a period of 4 hrs under argon gas protection. The amount of $CaH_2$ was calculated based on stoichiometric ratio as mentioned above. Reduction reaction process was performed in a horizontal tube furnace FIG. 11 shows the XRD pattern of the Ti—Al with a very limited amount of V (2 wt %) after heat treatment. A typical Ti—Al phase is shown.

FIG. 12 shows the EDX spectrum of the final powder particles (following final crushing and washing). FIG. 12(*a*) shows Ti, Al peaks as the major peaks, and a minor peak of V. The particle morphology is shown in FIG. 12(*b*). The micrograph shows very fine agglomerated particles.

These results confirm that the process of the present invention can be successfully used to reduce the oxide forms of the above mentioned materials to titanium alloy powder.

This pre-test has been repeated with a varied stoichiometric ratio [Ti:Al:V of 90:6:4 wt %] to produce Ti-6Al-4V. The final Ti—Al—V particles were then studied.

Figure 1:
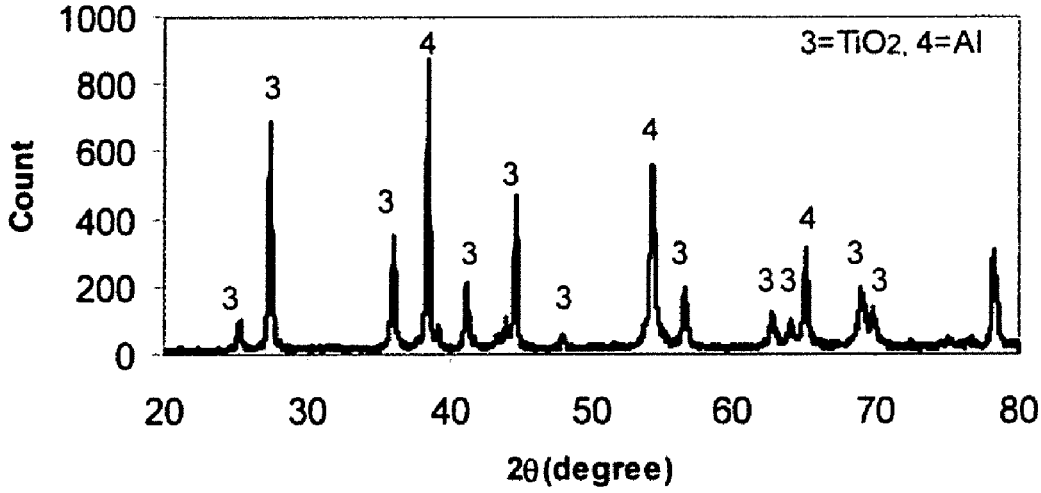
Figure 2:
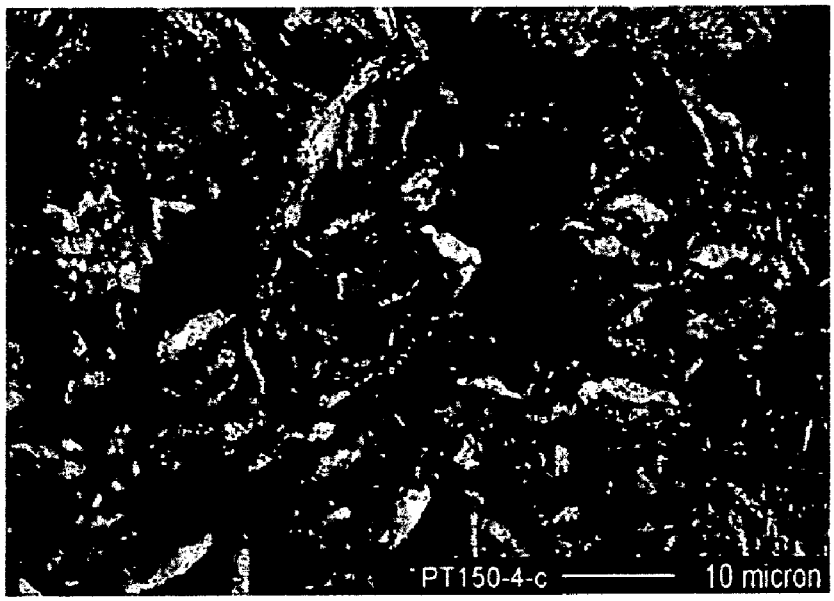
Figure 3:
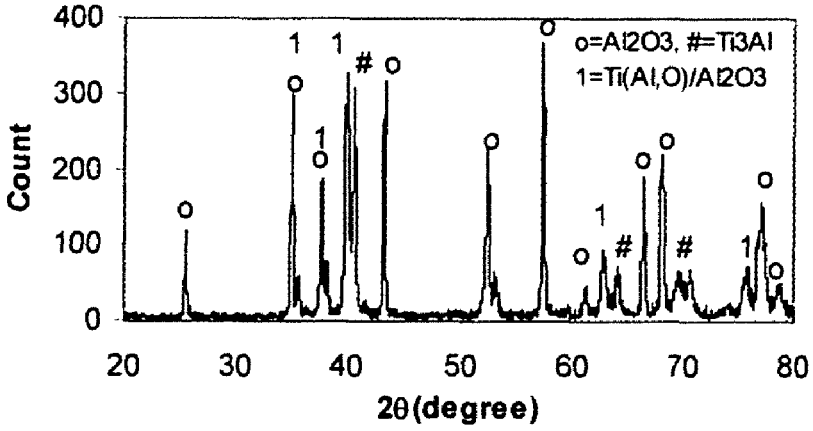
Figure 4:
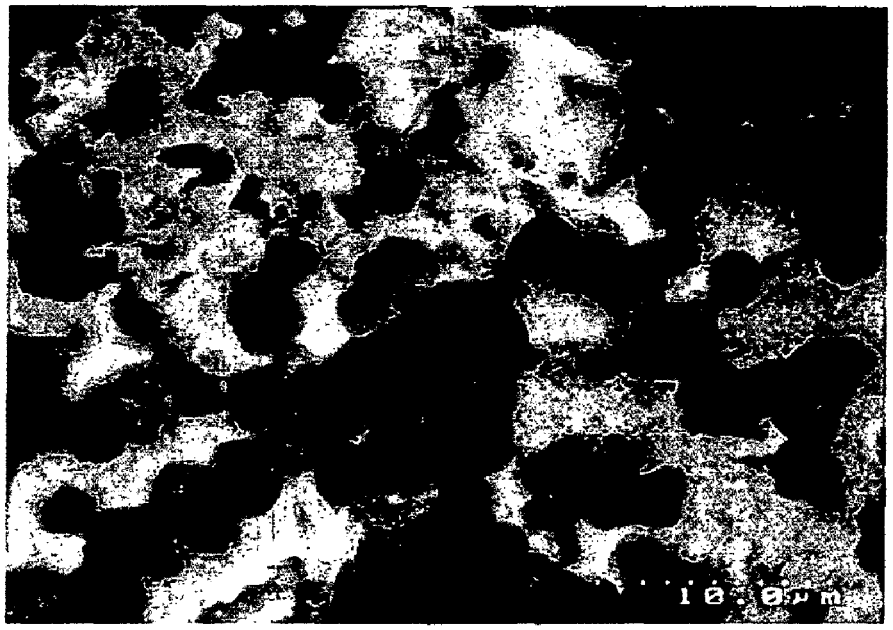
Figure 7:
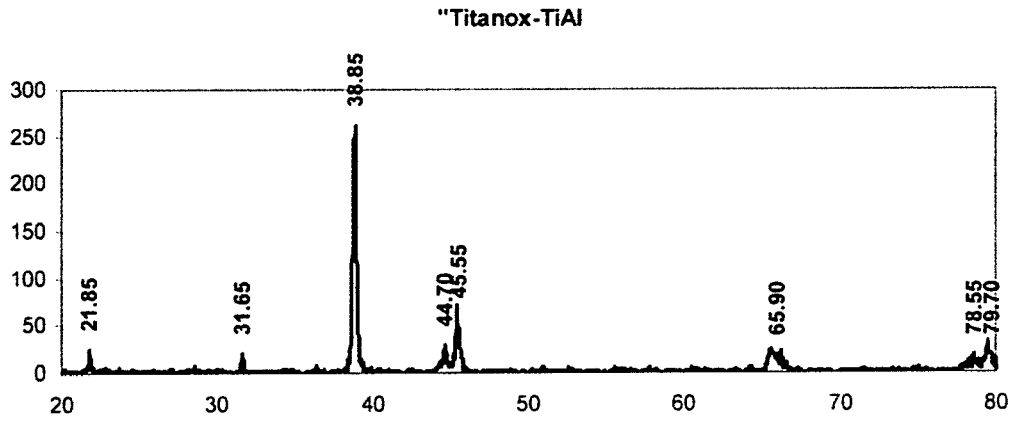
Figure 8:
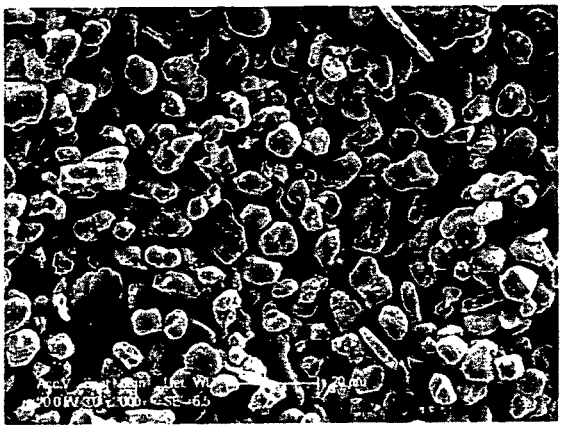
Figure 9:
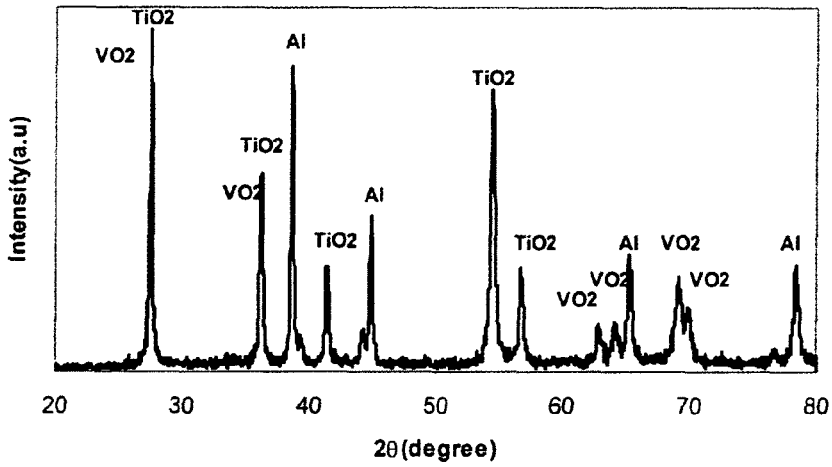
Figure 10:
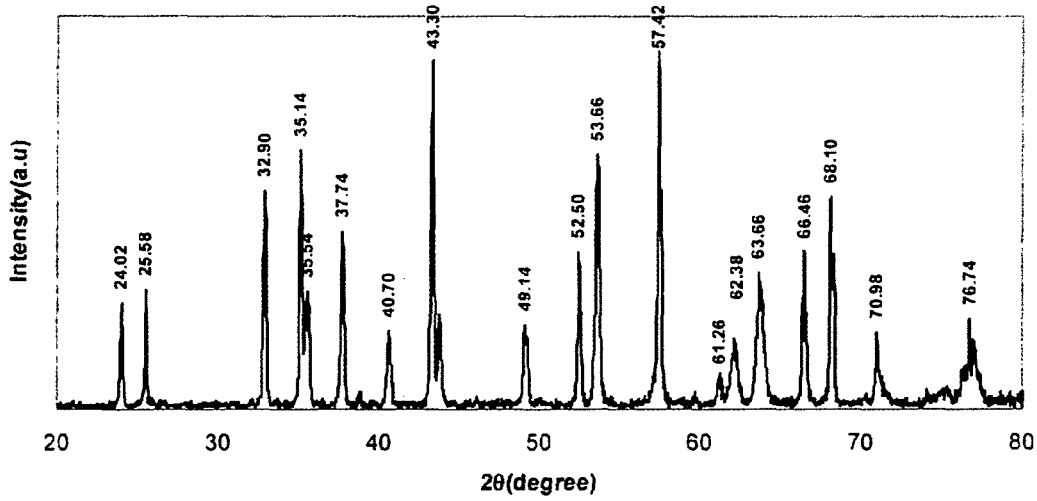
Figure 13:
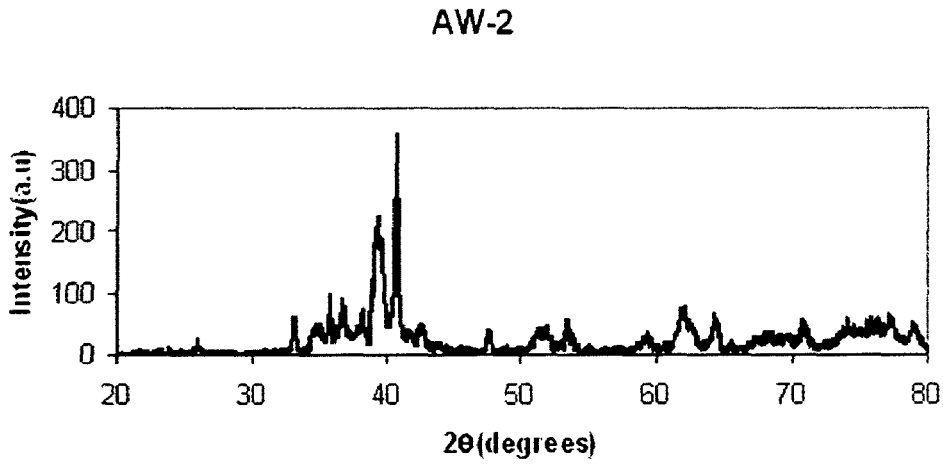
FIG. 13 shows the XRD pattern of the final Ti—Al—V product powder. The XRD pattern shows a typical Ti-6Al-4V phase.
Figure 14:
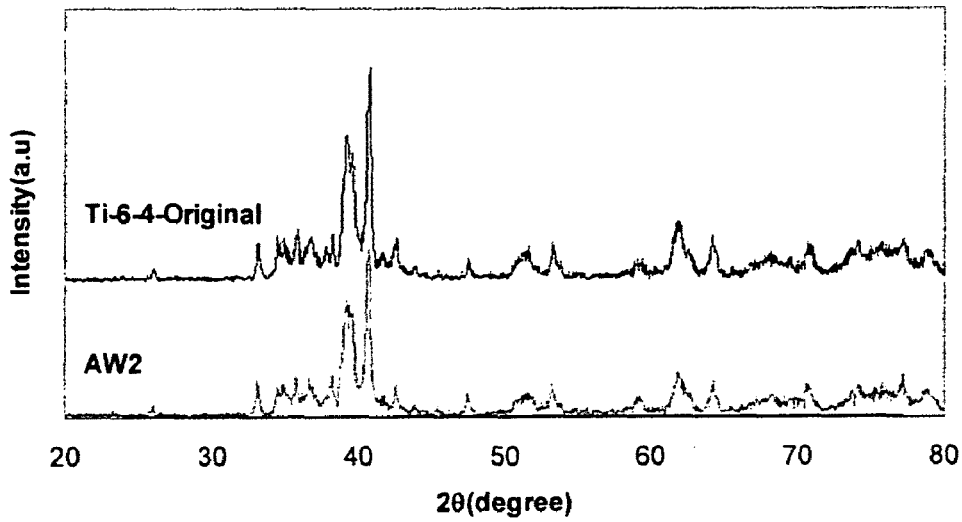
FIG. 14 shows a comparison of a Ti-6Al-4V standard commercially produced powder imported from China and the Ti-6Al-4V pattern of the powder produced following the process of this invention.
Figure 19:
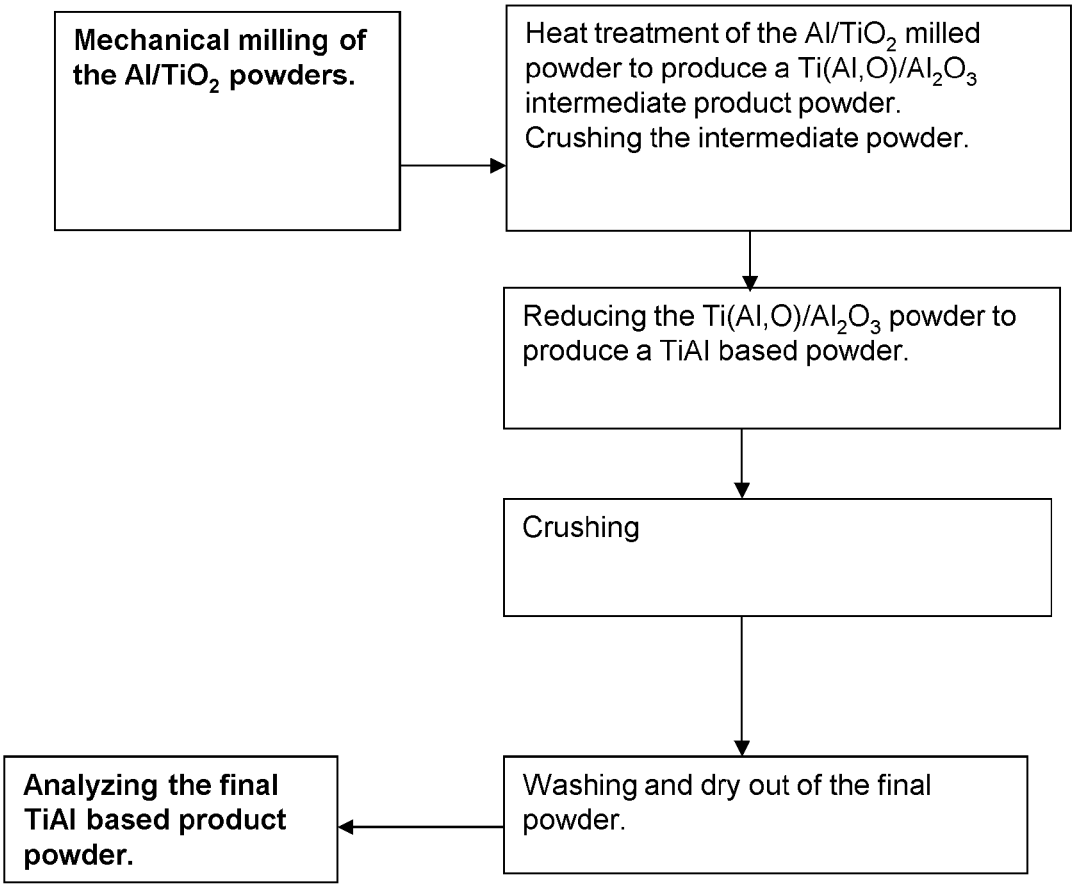
Figure 20:
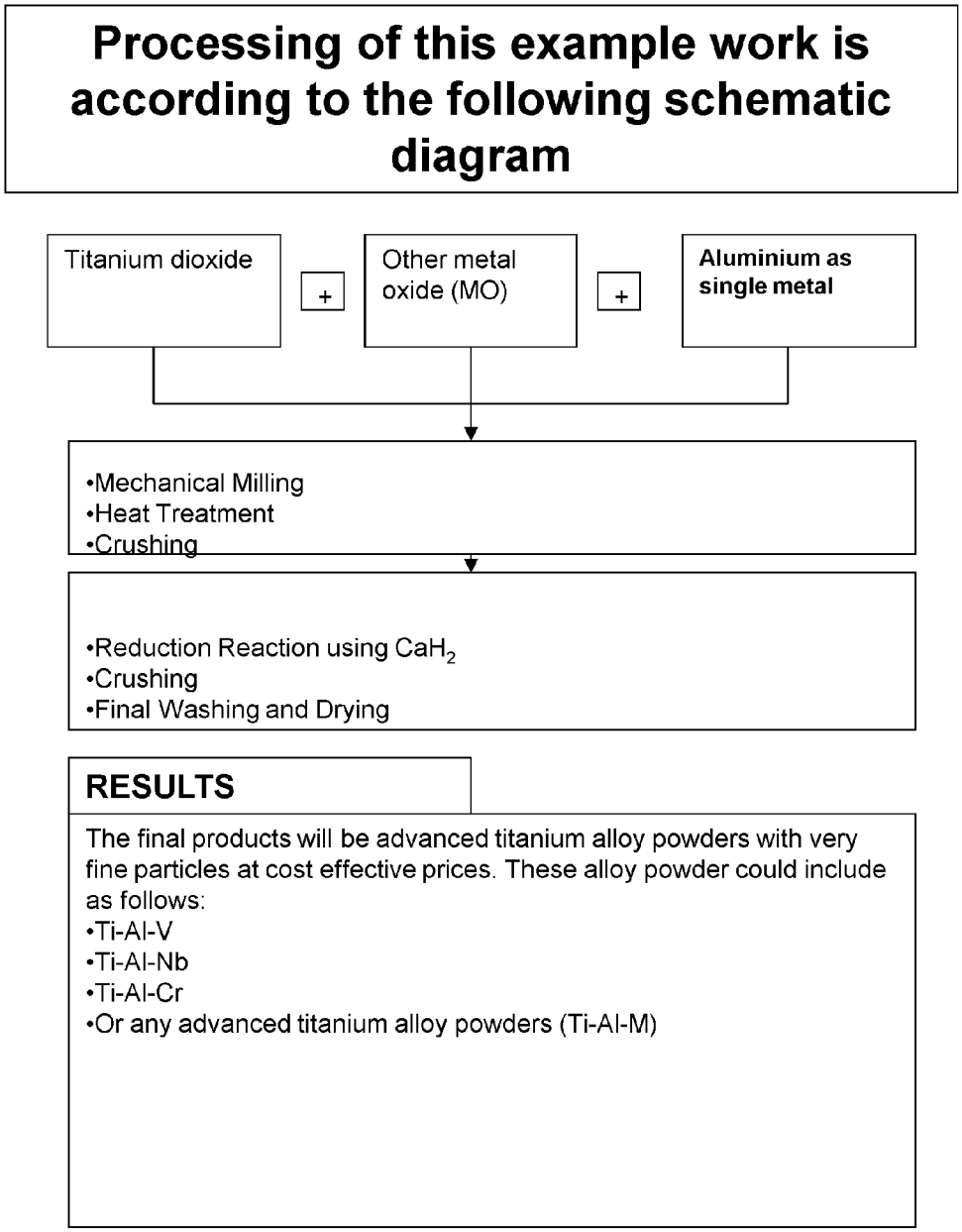

The final Ti-6Al-4V powder particle sizes are as shown in the following table—Table 2:

TABLE 2

| Diameter (μm) | q(%) | Sum: Q(r) (%) |
|---|---|---|
| 0.510 | 0.102 | 0.102 |
| 0.584 | 0.225 | 0.327 |
| 0.669 | 0.506 | 0.833 |
| 0.766 | 1.100 | 1.934 |
| 0.877 | 2.188 | 4.121 |
| 1.005 | 3.797 | 7.918 |
| 1.151 | 5.558 | 13.476 |
| 1.318 | 6.742 | 20.218 |
| 1.510 | 6.793 | 27.011 |
| 1.729 | 5.807 | 32.817 |
| 1.981 | 4.369 | 37.187 |
| 2.269 | 3.039 | 40.226 |
| 2.599 | 2.065 | 42.291 |
| 2.976 | 1.450 | 43.741 |
| 3.409 | 1.111 | 44.851 |
| 3.905 | 0.971 | 45.822 |
| 4.472 | 1.000 | 46.822 |
| 5.122 | 1.231 | 48.052 |
| 5.867 | 1.786 | 49.838 |
| 6.720 | 2.905 | 52.743 |
| 7.697 | 4.823 | 57.566 |
| 8.816 | 7.061 | 64.627 |
| 10.097 | 8.529 | 73.156 |
| 11.565 | 10.794 | 83.950 |
| 13.246 | 9.902 | 93.852 |
| 15.172 | 5.091 | 98.943 |
| 17.377 | 1.057 | 100.000 |

Table 2 shows fine particles of the Ti—Al—V final powder were produced.

The analysis of the final product shows successful production of Ti-6Al-4V alloy powder with very fine particle sizes. This indicates that reduction of Ti and V oxides with Al and $CaH_2$ was successful in achieving production of Ti—Al—V alloy powders.

Example 3

The starting materials for this example were chromium oxide, titanium oxide and aluminium powders. A stoichiometric ratio of $Cr_2O_3$:$TiO_2$:Al at 11.6:64.3:24.1 wt % was applied. The final powder was produced by following the steps of Example 2. This powder may be used for powder coating application.

FIG. 15: shows the XRD pattern of the final Ti—Al—Cr powder product after reduction, crushing and washing. The XRD pattern revealed Ti—Al as the dominant phase.

The powder particles of the final Ti—Al—Cr powder after reduction, crushing and washing were investigated using Scanning Electron Microscopy. FIG. 16(*a*) shows the EDX spectrum of Ti—Al—Cr particles. FIG. 16(*b*) shows a micrograph of a cross-section of Ti—Al—Cr particle.

The final Ti—Al—Cr powder particle sizes are as shown in the following table—Table 3:

TABLE 3

| Diameter (μm) | q(%) | Sum: Q(r) (%) |
|---|---|---|
| 1.151 | 0.128 | 0.128 |
| 1.318 | 0.466 | 0.594 |
| 1.510 | 1.204 | 1.799 |
| 1.729 | 2.234 | 4.033 |
| 1.981 | 3.083 | 7.116 |
| 2.269 | 3.343 | 10.459 |
| 2.599 | 3.045 | 13.504 |
| 2.976 | 2.505 | 16.008 |
| 3.409 | 1.995 | 18.003 |
| 3.905 | 1.635 | 19.638 |
| 4.472 | 1.448 | 21.086 |
| 5.122 | 1.434 | 22.520 |
| 5.867 | 1.612 | 24.132 |
| 6.720 | 2.050 | 26.182 |
| 7.697 | 2.866 | 29.048 |
| 8.816 | 4.141 | 33.190 |
| 10.097 | 5.828 | 39.018 |
| 11.565 | 8.708 | 47.726 |
| 13.246 | 12.689 | 60.415 |
| 15.172 | 16.061 | 76.476 |
| 17.377 | 14.718 | 91.194 |
| 19.904 | 7.415 | 98.609 |
| 22.797 | 1.391 | 100.000 |

Table 3 shows that fine particles of the Ti—Al—Cr final powder were produced. Bigger sizes could be attributed to the particle agglomeration.

Example 4

The starting materials for this example were yttrium oxide, titanium oxide and aluminium powders. A stoichiometric ratio of $Y_2O_3$:$TiO_2$:Al at 2:67.6:30.4 wt % was applied.

The final powder produced by following the steps of Example 2 was Ti—Al—Y. The small amount of Y included is intended to improve the quality of the titanium alloy. This powder may also be produced for powder coating application.

FIG. 17: shows the XRD pattern of the final Ti—Al—Y powder product after reduction, crushing and washing. The XRD pattern revealed Ti—Al as the dominant phase.

Using Scanning Electron Microscopy, the EDX technique was used to determine the composition of the material produced. FIG. 18 (*a*) shows the EDX spectrum of the final Ti—Al—Y powder. The analysis shows Ti—Al peaks as the major peaks and Y as the minor peak (due to the small amount of $Y_2O_3$ used in the starting material). An SEM micrograph of the final Ti—Al—Y powder after reduction, crushing and washing is shown in FIG. 18(*b*). This shows the relatively large particle size of the Ti—Al—Y powder produced. This is also shown in Table 4 where the measurements of the particle size distribution are tabulated.

The final Ti—Al—Y powder particles sizes are as shown in the following table—Table 4:

TABLE 4

| Diameter(μm) | q(%) | Sum: Q(r) (%) |
|---|---|---|
| 1.510 | 0.164 | 0.164 |
| 1.729 | 0.265 | 0.429 |
| 1.981 | 0.377 | 0.806 |
| 2.269 | 0.486 | 1.292 |
| 2.599 | 0.583 | 1.875 |
| 2.976 | 0.669 | 2.544 |
| 3.409 | 0.753 | 3.297 |
| 3.905 | 0.845 | 4.142 |

TABLE 4-continued

| Diameter(μm) | q(%) | Sum: Q(r) (%) |
|---|---|---|
| 4.472 | 0.956 | 5.098 |
| 5.122 | 1.095 | 6.192 |
| 5.867 | 1.264 | 7.456 |
| 6.720 | 1.462 | 8.917 |
| 7.697 | 1.680 | 10.597 |
| 8.816 | 1.906 | 12.503 |
| 10.097 | 2.127 | 14.630 |
| 11.565 | 2.321 | 16.950 |
| 13.246 | 2.464 | 19.415 |
| 15.172 | 2.549 | 21.964 |
| 17.377 | 2.598 | 24.561 |
| 19.904 | 2.651 | 27.212 |
| 22.797 | 2.753 | 29.965 |
| 26.111 | 2.938 | 32.904 |
| 29.907 | 3.220 | 36.123 |
| 34.255 | 3.609 | 39.732 |
| 39.234 | 4.191 | 43.922 |
| 44.938 | 5.149 | 49.071 |
| 51.471 | 6.379 | 55.451 |
| 58.953 | 7.590 | 63.040 |
| 67.523 | 8.204 | 71.245 |
| 77.340 | 8.346 | 79.590 |
| 88.583 | 7.130 | 86.720 |
| 101.460 | 4.781 | 91.501 |
| 116.210 | 2.792 | 94.293 |
| 133.103 | 1.789 | 96.083 |
| 152.453 | 1.293 | 97.376 |
| 174.616 | 1.005 | 98.381 |
| 200.000 | 0.777 | 99.157 |
| 229.075 | 0.534 | 99.691 |
| 262.376 | 0.309 | 100.000 |

Table 4 shows the particle sizes of the final Ti—Al—Y powder produced.

Examples 2 to 4 show the successful production of a variety of multi-metal alloys including Ti and Al produced by the process of the present invention. Additional metals (eg V, Ni, Nb, Y, Cr, Co, Mo, etc) can be added to the alloy in different weight ratios as desired, including at low levels. Production of other multi-metal alloys based on Ti and Al will also be possible as would be apparent to a skilled person once in possession of this invention.

Reference within this specification to prior art products and/or processes should not be taken to be an admission that such prior art will constitute common general knowledge of a skilled person in any particular jurisdiction unless the content of that reference indicates otherwise.

While in the foregoing description there has been made reference to specific components or integers of the invention having known equivalents then such equivalents are herein incorporated as if individually set forth.

Although this invention has been described by way of example only and with reference to possible embodiments thereof it is to be understood that modifications or improvements may be made without departing from the scope or spirit of the invention as defined in the attached claims.

The invention claimed is:

1. A process for the manufacture of titanium alloy powders, the method including the following steps:

(a) mechanically milling titanium dioxide, and optionally one or more other oxides, together with aluminium powder;

(b) heating the mixture to a temperature of between about 700° C. and about 1200° C. in a vacuum or an inert environment to form a titanium metal matrix ceramic composite;

(c) crushing the titanium metal matrix ceramic composite;

(d) mixing the crushed titanium metal matrix ceramic composite with a suitable reducing agent and heating to a temperature between about 1100° C. and about 1500° C. in a vacuum or an inert environment to reduce the oxide components of the titanium metal matrix ceramic composite, wherein the suitable reducing agent is calcium hydride or magnesium hydride;

(e) crushing and washing the result of step (d); and (f) recovering the titanium alloy powder.

2. The process according to claim 1 wherein step (b) is carried out at a temperature of between about 900° C. and about 1100° C.

3. The process according to claim 1 wherein step (d) is carried out at a temperature of between about 1100° C. and about 1300° C.

4. The process according to claim 1, wherein step (a) is carried out for a time of between about one and about ten hours.

5. The process according to claim 1, wherein step (a) includes titanium dioxide and at least one other metal oxide compound, and the titanium alloy powder recovered in step (f) is a titanium based metal alloy powder.

6. The process according to claim 1, wherein step (a) includes titanium dioxide and at least one other metal oxide or at least one non-metal oxide.

7. The process according to claim 5 or claim 6 wherein the at least one other metal oxide or the at least one non-metal oxide is selected from the group consisting of Ni, V, Co, Nb, Cr, Mo, Y and Si oxides.

8. The process according to claim 7 wherein the titanium alloy powder recovered is selected from the group consisting of Ti—Al—Ni, Ti—Al—V, Ti—Al—Co, Ti—Al—Nb, Ti—Al—Cr, Ti—Al—Mo, Ti—Al—Y and a Ti—Al—Si alloy.

9. The process according to claim 6 wherein the non-metal oxide is $SiO_2$ and the product of step (f) is a Ti—Al—Si alloy.

10. The process according to claim 1 wherein step (a) is carried out in a vacuum or an inert environment.

11. The process according to claim 1 wherein step (a) combines $TiO_2$ and Al powders; the product of step (d) is a mixture of Ti—Al and soluble compounds; and a Ti—Al alloy is recovered in step (f).

12. The process according to claim 1 wherein step (c) is also carried out in a vacuum or an inert environment.

13. The process according to claim 1 wherein step (b) is carried out in an inert environment and steps (c), and (d) are carried out in the same inert environment.

14. The process according to claim 13 wherein the inert environment in steps (a), (b), (c), and (d) is an argon environment.

15. The process according to claim 1 wherein step (b) is carried out for at least about ten minutes.

16. The process according to claim 15 wherein step (b) is carried out for between about one and two hours.

17. The process according to claim 1 wherein step (d) is carried out for between about two and about eight hours.

18. The process according to claim 17 wherein step (d) is carried out for between about two and about four hours.

19. The process according to claim 1 wherein the suitable reducing agent is calcium hydride.

20. The process according to claim 1 wherein the crushing in step (c) is carried out for a time of between about ten minutes and about one hour.

21. The process according to claim 1 wherein the crushing steps in steps (c) and (e) use a mechanical milling machine.

22. The process according to claim 1 wherein the washing step in step (e) is a multi-step process using deionised water and a weak organic acid.

23. The process according to claim 22 wherein the washing step in (e) is a multi-step process using acetic acid in deionised water.

24. The process according to claim 1, wherein the crushing in step (e) is carried out for a time between about ten minutes and about one hour.

25. A process for the manufacture of titanium aluminide powder, the method including the following steps:

(a) mechanically milling titanium dioxide together with aluminium powder;

(b) heating the mixture to a temperature of between about 700° C. and about 1200° C. in a vacuum or an inert environment to form a titanium metal matrix ceramic composite;

(c) crushing the titanium metal matrix ceramic composite;

(d) mixing the crushed titanium metal matrix ceramic composite with a suitable reducing agent and heating to a temperature between about 1100° C. and about 1500° C. in a vacuum or an inert environment to reduce the oxide component of the titanium metal matrix ceramic composite, wherein the suitable reducing agent is calcium hydride or magnesium hydride;

(e) crushing and washing the result of step (d); and (f) recovering the titanium aluminide powder.

26. The process according to claim 25 wherein step (b) is carried out at a temperature of between about 900° C. and about 1100° C.

27. The process according to claim 25 wherein step (d) is carried out at a temperature of between about 1100° C. and about 1300° C.

28. A process for the manufacture of titanium alloy powders, the method including the following steps:

(a) heating a blended mixture of titanium dioxide, and optionally one or more other oxides, together with aluminium powder to a temperature of between about 700° C. and about 1200° C. in a vacuum or inert environment to form a titanium metal matrix ceramic composite;

(b) crushing the titanium metal matrix ceramic composite;

(c) mixing the crushed titanium metal matrix ceramic composite with a suitable reducing agent and heating to a temperature between about 1100° C. and about 1500° C. in a vacuum or an inert environment to reduce the oxide components of the titanium metal matrix ceramic composite, wherein the suitable reducing agent is calcium hydride or magnesium hydride;

(d) crushing and washing the result of step (c); and (e) recovering the titanium alloy powder.

29. The process according to claim 28 wherein step (a) is carried out at a temperature of between about 900° C. and about 1100° C.

30. The process according to claim 28 wherein step (c) is carried out at a temperature of between about 1100° C. and about 1300° C.

31. The process according to claim 28 wherein the blended mixture in step (a) includes titanium dioxide and at least one other metal oxide or at least one non-metal oxide.

32. The process according to claim 31 wherein the blended mixture in step (a) includes titanium dioxide and another metal oxide compound, and the titanium alloy powder recovered in step (e) is a titanium based metal alloy powder.

33. The process according to claim 31 or 32 wherein the at least one other metal oxide or the at least one non-metal oxide is selected from the group consisting of Ni, V, Co, Nb, Cr, Mo, Y and Si oxide.

34. The process according to claim 33 wherein the alloy powder produced is a Ti—Al—Ni, Ti—Al—V, Ti—Al—Co, Ti—Al—Nb, Ti—Al—Cr, Ti—Al—Mo, Ti—Al—Y or a Ti—Al—Si alloy.

35. The process according to claim 31 wherein the at least one non-metal oxide is $SiO_2$ and the product of step (e) is a Ti—Al—Si alloy.

36. The process according to claims 28 wherein the blended mixture in step (a) combines $TiO_2$ and Al powders, the product of step (c) is a mixture of Ti—Al and soluble compounds, and a Ti—Al alloy is recovered in step (e).

37. The process according to claim 28 wherein step (a) is carried out in an inert environment and steps (b), and (c) are carried out in the same inert environment.

38. The process according to claim 37 wherein the inert environment is an argon environment.

39. The process according to claim 28 wherein step (a) is carried out for at least about ten minutes.

40. The process according to claim 39 wherein step (a) is carried out for between about one and about two hours.

41. The process according to claim 28 wherein step (c) is carried out for between about two and about eight hours.

42. The process according to claim 41 wherein step (c) is carried out for between about two and about four hours.

43. The process according to claim 28 wherein the suitable reducing agent is calcium hydride.

44. The process according to claim 28 wherein the crushing in step (b) is carried out for a time of between about ten minutes and about one hour.

45. A process according to claim 28 wherein the blended mixture in step (a) is blended by mechanical milling or low energy mixing techniques.

46. The process according to claim 28, wherein the crushing in step (d) is carried out for a time of between about ten minutes and about one hour.

47. A process for the manufacture of titanium alloy powders, the method including the following steps:

(a) blending titanium dioxide, and optionally one or more other oxides, together with aluminium powder;

(b) heating the mixture to a temperature of between about 700° C. and about 1200° C. in a vacuum or an inert environment to form a titanium metal matrix ceramic composite;

(c) crushing the titanium metal matrix ceramic composite;

(d) mixing the crushed titanium metal matrix ceramic composite with a suitable reducing agent and heating to a temperature between about 1100° C. and about 1500° C. in a vacuum or an inert environment to reduce the oxide components of the titanium metal matrix ceramic composite, wherein the suitable reducing agent is calcium hydride or magnesium hydride;

(e) crushing and washing the result of step (d); and (f) recovering the titanium alloy powder.

48. A process according to claim 47 wherein the blending includes mechanical milling or low energy mixing techniques.

* * * * *

UNITED STATES PATENT AND TRADEMARK OFFICE

CERTIFICATE OF CORRECTION

PATENT NO. : 8,328,899 B2
APPLICATION NO. : 12/374466
DATED : December 11, 2012
INVENTOR(S) : Gorgees Adam et al.

It is certified that error appears in the above-identified patent and that said Letters Patent is hereby corrected as shown below:

In the Specification

At column 2, line 20, please delete "(e" and insert therefore, --(f)--.

At column 5, lines 24-25, please delete "PCT/NZ003/00159," and insert therefore, --PCT/NZ2003/00159,--.

At column 5, line 33, please delete "PCT/N7003/00159" and insert therefore, --PCT/NZ2003/00159--.

At column 10, line 56, please delete "1200 C.°" and insert therefore, --1200° C.--.

In the Claims

At column 16, line 12, in claim 36, please delete "claims" and insert therefore, --claim--.

Signed and Sealed this
Seventh Day of October, 2014

Michelle K. Lee

Michelle K. Lee
*Deputy Director of the United States Patent and Trademark Office*